US008353563B2

(12) United States Patent
Bonat

(10) Patent No.: US 8,353,563 B2
(45) Date of Patent: Jan. 15, 2013

(54) ROLLER EXTRACTION GUIDE

(75) Inventor: Guenter Bonat, Lochau (AT)

(73) Assignee: Fulterer Gesellschaft m.b.H., Lustenau (AT)

( * ) Notice: Subject to any disclaimer, the term of this patent is extended or adjusted under 35 U.S.C. 154(b) by 491 days.

(21) Appl. No.: 12/588,161

(22) Filed: Oct. 6, 2009

(65) Prior Publication Data

US 2010/0086244 A1 Apr. 8, 2010

(30) Foreign Application Priority Data

Oct. 7, 2008 (AT) ..... 1565/2008
Jun. 3, 2009 (EP) ..... 09 007 350

(51) Int. Cl.
*A47B 88/00* (2006.01)

(52) U.S. Cl. ..... 312/333

(58) Field of Classification Search ..... 312/333, 312/319.1, 334.44–334.47, 334.7, 334.1, 312/334.8, 330.1, 334.4, 334.5, 334.12, 334.15, 312/334.18, 334.25, 334.26, 334.33, 334.39, 312/334.43; 384/19, 21, 22
See application file for complete search history.

(56) References Cited

U.S. PATENT DOCUMENTS 3,104,142 A * 9/1963 Geren et al. ..... 312/333
4,121,878 A 10/1978 Lokken
4,447,095 A * 5/1984 Fielding ..... 384/19
4,765,699 A * 8/1988 Bessinger et al. ..... 312/334.46
6,848,759 B2 * 2/2005 Doornbos et al. ..... 312/319.1
6,902,244 B1 * 6/2005 Chen ..... 312/334.4
2004/0174101 A1 * 9/2004 Lin ..... 312/333
2011/0037362 A1 * 2/2011 Park et al. ..... 312/319.1

FOREIGN PATENT DOCUMENTS

| | | | |
|---|---|---|---|
| AT | 389 218 | | 11/1989 |
| AT | 393 948 | | 1/1992 |
| AT | 401 334 | | 8/1996 |
| DE | 87 14 720 | | 2/1988 |
| DE | 38 18 225 | | 12/1989 |
| EP | 1 532 892 | | 5/2005 |
| JP | 06245831 | * | 9/1994 |

OTHER PUBLICATIONS

European Search Report issued Jan. 29, 2010 in EP 09 00 7350.
Austrian Search Report issued Jul. 1, 2009 in AT 1565/2008.

* cited by examiner

*Primary Examiner* — Janet M Wilkens
(74) *Attorney, Agent, or Firm* — Frommer Lawrence & Haug LLP

(57) ABSTRACT

A roller pull-out guide pulls out a furniture part from a furniture body in a pull-out direction and slides the furniture part into the furniture body in a slide-in direction. The guide includes at least one guide rail and at least one roller guided in this guide rail as well as a self-retraction device with a spring-loaded, tiltably and displaceably supported tilt slide for retracting the furniture part in the slide-in direction. The tilt slide includes a claw which engages on the roller for the retraction of the furniture part in the slide-in direction.

25 Claims, 14 Drawing Sheets

ROLLER EXTRACTION GUIDE

BACKGROUND OF THE INVENTION a) Field of the Invention

The present invention relates to a roller pull-out guide for pulling out a furniture part from a furniture body in a pull-out direction and for sliding the furniture part into the furniture body in a slide-in direction. The guide includes at least one guidance rail and at least one roller guided therein, as well as a self-retraction device with a spring-loaded, tiltably and displaceably supported tilt slide for the retraction of the furniture part in the slide-in direction.

b) Description of Related Prior Art

Roller pull-out guidances of this type are known per se. The self-retraction device serves for automatically pulling the furniture part in the slide-in direction completely into the furniture body, thus into the closed position, after the furniture part has been slid in, for example manually, over a certain length of path in the slide-in direction. Within the prior art, several solutions with tilt slides are known. It is also known to equip such retraction mechanisms with slide-in attenuators in order to attenuate in the last section the push-in movement of the roller pull-out guidance. Such an attenuated retraction mechanism or self-retraction device, in which the tilt slide cooperates with a slide-in attenuator, is disclosed for example in EP 1 532 892 A1. Each of the tilt slides of the self-retraction devices cooperates with an entrainer disposed on the pull-out furniture part. Similar self-retraction devices, however without attenuators, are described, for example, in AT 401 334 B, in which a tilt slide displaceable against the force of a spring is also provided. The tilt slide is disposed tiltably about a tilt axis on a sliding carriage displaceable in a straight line in the pull-out direction of the drawer against the force of the spring. In the self-retraction device disclosed in AT 393 948 B a tilt slide is also provided, which is displaceable along a guide track against the force of a spring. The guide track has a straight section and a curved section which effects the swivelling of the tilt slide about an imaginary axis into its tilted end position.

SUMMARY OF THE INVENTION

The present invention addresses the problem of providing a generic roller pull-out guide, wherein, using as few parts as possible and with as few working steps as possible, high operational reliability can be ensured.

This is attained in that the tilt slide includes a claw that, for the purpose of retracting the furniture part in the slide-in direction, engages on the roller.

Expressed differently, it is consequently provided that the tilt slide engages via the claw associated with it on a roller of the roller pull-out guidance itself Therefore, additional entrainers, such as for example hooks or parts formed out similarly, on which the tilt slide engages and conventionally used in prior art, can be omitted. This saves, for one, working steps, however, for another, also parts. Moreover, such a roller pull-out guidance can also be built highly compactly. However, a special advantage lies therein that, in spite of sufficient movement play, high operational reliability can be ensured.

It is advantageously provided that the roller is rotatably supported, preferably rotatably secured in place, on a second rail of the roller pull-out guidance, preferably by means of a roller pivot axle. It is thus preferred that at least one roller is rotatably supported on a rail. On the rails of the roller pull-out guidance, furthermore, additional rollers can be rotatably supported or secured in place preferably by means of their roller pivot axles. The roller or rollers have herein preferably a bearing function. Additionally, or alternatively, to the additional rollers, roller pull-out guidances according to the invention can also be implemented with sliding carriages known per se, in which balls and/or cylinders are rotatably supported. The guide rail can be, for example, the rail that is fixed on the furniture body. This rail is conventionally referred to as the body rail. The second rail in this case is advantageously the rail of the roller pull-out guidance, which is secured in place on the furniture part supported displaceably relative to the furniture body. The guide rail and the second rail are in this case advantageously supported one in the other such that they are displaceable by means of said rollers and/or sliding carriages. One each of such roller pull-out guidances can be disposed on two opposite sides of the furniture part. The roller pull-out guidance can in each instance also additionally include at least one further rail, for example, a center rail, which is movable or displaceable relative to the guide rail as well as also to the second rail. Roller pull-out guidances according to the invention can thus also be implemented as differential pull-out guidances known per se. A roller pull-out guidance, in which on each side of the furniture part three rails are supported one in the other displaceably with respect to one another, is described for example in EP 1 532 892 A1.

As already explained above, an essential fundamental concept of the invention is that the tilt slide includes a claw which, for retracting the furniture part in the slide-in direction, engages on the roller. The retraction of the furniture part comprises herein two sections. First, the claw of the tilt slide must engage on the roller. In the following, this is referred to as a contacting process. Succeeding it is the retraction process proper, in which the self-retraction device pulls in the slide-in direction via the tilt slide on the roller or on the second rail connected therewith. The retraction of the furniture part refers to the engagement process as well as also to the retraction process. In a first group of embodiments of the invention it can be provided that the contacting process as well as also the retraction process takes place via the engagement of the claw of the tilt slide on the roller. A method for operating such roller pull-out guidances according to the invention can in this case provide that the tilt slide is tilted from a first tilt position into the second tilt position by the striking of the roller onto the claw, wherein through this tilting the claw and the roller are brought into engagement with one another and, subsequent to this striking, the roller caught on the claw of the tilt slide is retracted by the tilt slide in the slide-in direction. In this approach the second rail is thus retracted by the claw engaging directly on the roller and thus is pulled on the roller. These variants are distinguished thereby that especially few parts are required. However, they can have the disadvantage that through the contact of the claw on the roller increasing frictional forces occur during the retraction process.

If these increased frictional forces are to be avoided, in a second group of embodiments of the invention can be provided that the engagement of the claw on the roller only takes place during the contacting process. It can thus also be provided that the retraction of the furniture part in the slide-in direction occurs only partially, for example only comprising the contacting process, through the engagement of the claw on the roller. Other means can be provided for the retraction process in these variants of the invention, with which means the tilt slide engages on the second rail. Having stated such, a preferred group of embodiments of the invention provides that on the tilt slide a first coupling part is disposed and on the second rail a second coupling part, wherein the coupling parts in a first tilt position of the tilt slide are detached from one another and in a second tilt position of the tilt slide are engaged with one another, wherein in the first tilt position the second rail and the tilt slide are movable in the pull-out direction and/or in the slide-in direction relative to one another, and, in the second tilt position, the second rail and the tilt slide are per force coupled with one another with respect to a movement in the pull-out direction and/or in the slide-in direction. Coupled per force means in this connection in particular that rail and tilt slide in the second tilt position can only be moved jointly in the pull-out direction and/or in the slide-in direction. A method for operating such a roller pull-out guide can in this case provide that the tilt slide through the striking of the roller on the claw is tilted from the first tilt position into the second tilt position whereby through this tilting the coupling parts are brought into engagement with one another and subsequently the second rail is pulled by the tilt slide in the slide-in direction via the coupling parts while being caught on the tilt slide. In these variants is thus provided that the tilting of the tilt slide takes place during the contacting process via the engagement of the claw of the tilt slide on the roller. During the subsequent retraction process, however, the tilt slide engages directly on the second rail via the coupling parts brought into engagement with one another, such that the weight of the second rail and of the furniture part, connected therewith and to be retracted, no longer acts via the claw onto the roller. The frictional forces between roller and claw can hereby be minimized or excluded during the retraction process.

The claw of the tilt slide can in principle engage at different sites on the roller. It is, for example, conceivable that the claw of the tilt slide engages on the roller pivot axle of the roller. However, especially preferably is provided that the roller has a running surface with which it runs in the guide rail and the claw of the tilt slide engages on the running surface of the roller. This permits an especially operationally reliable roller pull-out guidance which, nevertheless, can be equipped with much movement play. This is, moreover, also a highly space-saving variant. It is preferably provided that the claw has, preferably at least sectionwise, for example a circular arc shape curved claw face and/or one such delimiting an indentation in the claw, with which it engages on, preferably the running surface, of the roller. In order for the claw of the tilt slide to be able to securely engage the roller, preferred embodiments provide that the length of the claw face, measured in the pull-out direction, is at least one eighth, preferably at least one fourth, of the total circumference of the running surface of the roller. Herein is to be taken into consideration in particular that portion of the claw face which can, in fact, encompass the roller. In the case of curved claw faces, the length specification refers to a measurement along the curved claw face in the pull-out direction and not to the imaginary chord, extending in the pull-out direction, between the end points of the claw face.

The claw can include an indentation for receiving the roller, which is delimited by two, preferably curved, claw arms.

In order to be able to move the roller into position again following a potential malfunction of the roller pull-out guidance, a position in which it can be encompassed by the claw of the tilt slide, especially preferred embodiments of the invention provide that at least one of the claw arms is realized such that it is elastically deformable and has an oblique run-up face, oblique with respect to the slide-in direction. By running-up on the roller against the oblique run-up face and through the elastic deformation of the claw arms, the roller is displaceable past the claw arms into the indentation of the claw.

In order to attenuate the push-in movement of the movable furniture part during the retraction in the slide-in direction, it is feasible to integrate into roller pull-out guidances according to the invention attenuators known per se for movable furniture parts. An especially preferred embodiment provides that on the tilt slide is disposed, preferably integrally, an attenuator part of an attenuator, including at least two attenuator parts movable relative to one another, preferably rotation attenuators or linear attenuators. The number of parts and the space requirement is hereby also minimized.

Further details and features of preferred embodiments of the invention will be explained in conjunction with the following description of the figures.

DESCRIPTION OF THE PREFERRED EMBODIMENTS

Figure 1:
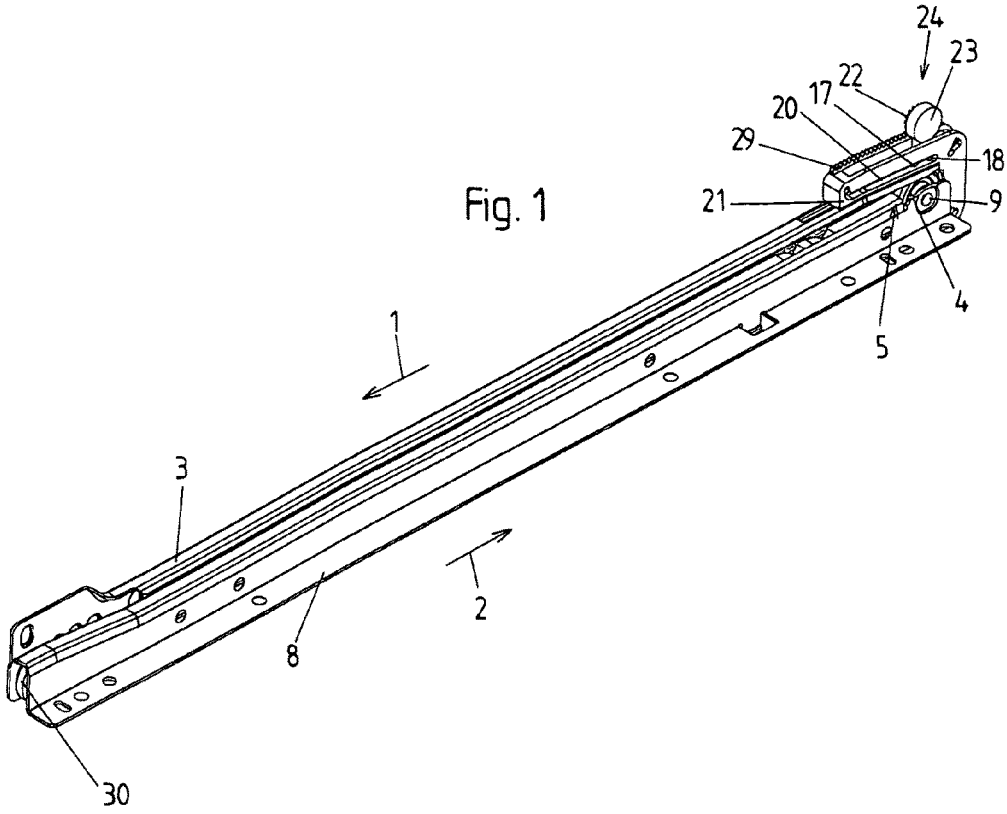
FIGS. 1 to 13 are different views and component parts of a first embodiment according to the invention.
Figure 2:
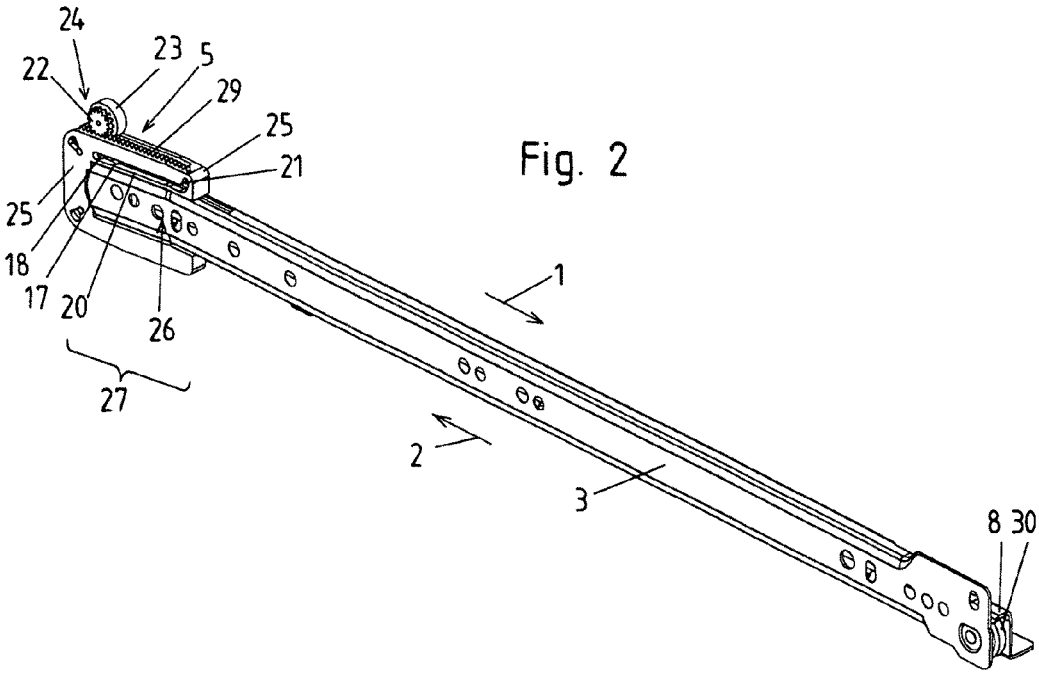

In FIGS. 1 and 2 is shown the roller pull-out guide of the first embodiment from two different sides. It comprises a guide rail 3 and a second rail 8 displaceably supported therein. These two rails 3 and 8 can be pulled apart telescopingly in the pull-out direction 1 and be slid one into the other in the opposite slide-in direction 2. In the depicted embodiment, the guide rail 3 forms the body rail, which conventionally (not shown here) is secured on the furniture body. On the second rail 8 is secured the slide-in and pull-out furniture part (not shown here), such as for example a drawer. In the depicted embodiment, this is a pure roller pull-out guidance. That means, rails 3 and 8 are exclusively supported via rollers, here rollers 30 and 9, such that they are stayed on one another and displaceable. As already explained above, all depicted embodiments can also be modified to the extent that, for one, more than two rails movable in the manner of a telescope with respect to one another, can be provided. For example, between the guide rail 3 and the second rail 8, as known per se, at least one center rail can be supported. This is especially advantageous in so-called full pull-outs, in which the movable furniture part can be completely pulled out of the furniture body. For another, however, this does not necessarily involve a pure roller guidance. As explained above, instead of individual rollers, sliding carriages as are known within prior art, supported on cylinders or balls, can be integrated into the roller pull-out guidance.

For the sake of completeness, reference is made to the fact that conventionally on each of two opposing sides of the movable furniture part, one of the roller pull-out guidances depicted in FIGS. 1 and 2 is disposed in order for the movable furniture part to be supported on both sides. However, not every roller pull-out guidance according to the invention must be implemented with a corresponding self-retraction device 5. In appropriate embodiments, it can also be entirely sufficient for only one of the two roller pull-out guidances according to the invention associated with the movable furniture part to be equipped with a corresponding self-retraction device 5.

Figure 3:
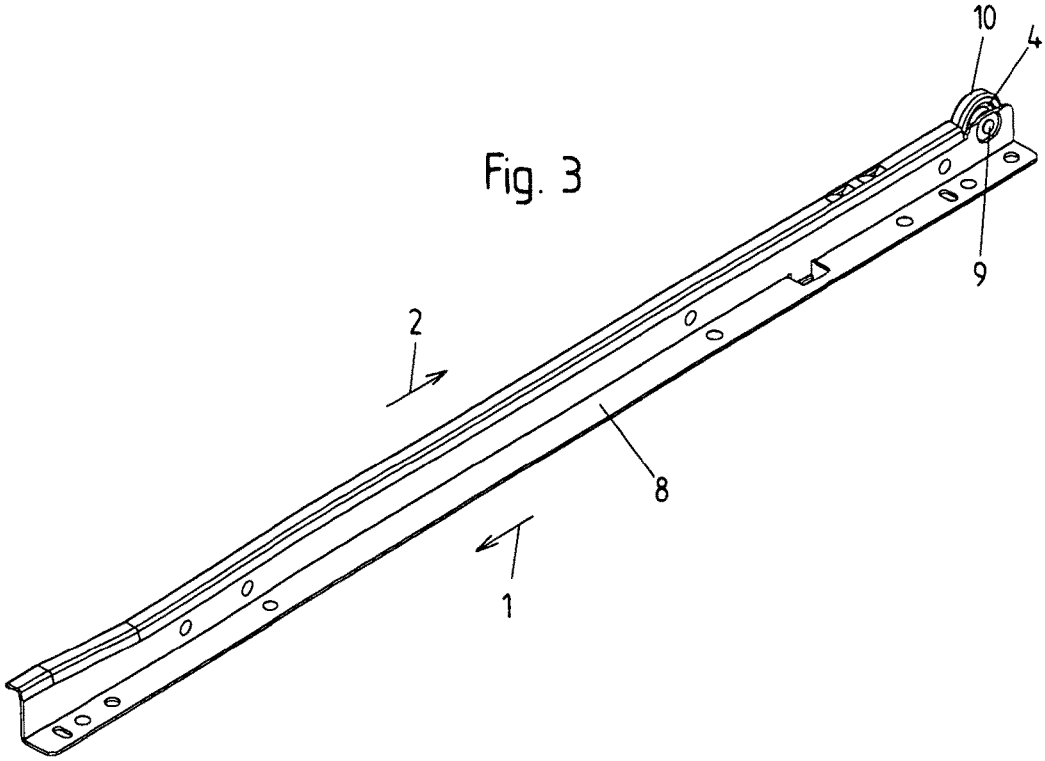
Figure 4:
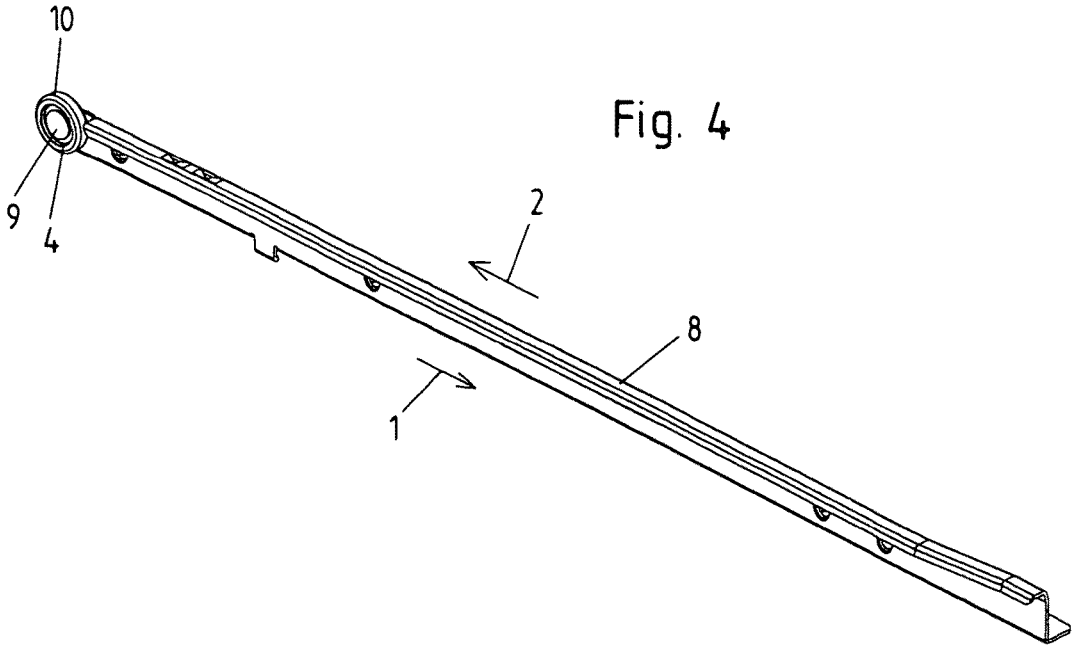

As is evident in FIGS. 1 and 2, the self-retraction device 5, viewed in the slide-in direction 2, is disposed on the rearward end of the guide rail 3. As will yet be explained in further detail, it cooperates with a roller 4, which, as is especially clearly visible in FIGS. 3 and 4, is secured on the second rail 8 rotatably by means of its roller pivot axle 9. Clearly evident in FIGS. 1 and 2 is also the attenuator 24 implemented as a rotation attenuator, which, in the depicted embodiment example, is connected integrally with the tilt slide 6. The details of the tilt slide 6 will still be explained further on. Evident in FIGS. 1 and 2 is in any event that the rotation attenuator 24 realized here, includes as a first attenuator part 22 a toothed wheel which engages into a toothed rack 29 on housing 25. The toothed wheel 22 is rotatably supported in the housing of the attenuator 24 forming the second attenuator part 23. Such attenuators are known per se for furniture fitting parts. They can be implemented in all physical forms known in the prior art.

FIGS. 3 and 4 show the second rail 8 on which the movable furniture part is secured. It bears across the roller pivot axle 9, in the depicted embodiment example that roller 4, which cooperates with the tilt slide 6 or its claw 7. Claw 7 denotes herein generally the element of the tilt slide-6 with which this claw engages on roller 4 or contacts the same. This roller 4 in the depicted variant is disposed on the rail 8 at the rearward end of the rail in the slide-in direction 2. It is understood that this does not need to be such, the self-retraction device 5 and the roller 4 associated with it, can, of course, also be disposed further forward on the rails.

Figure 5:
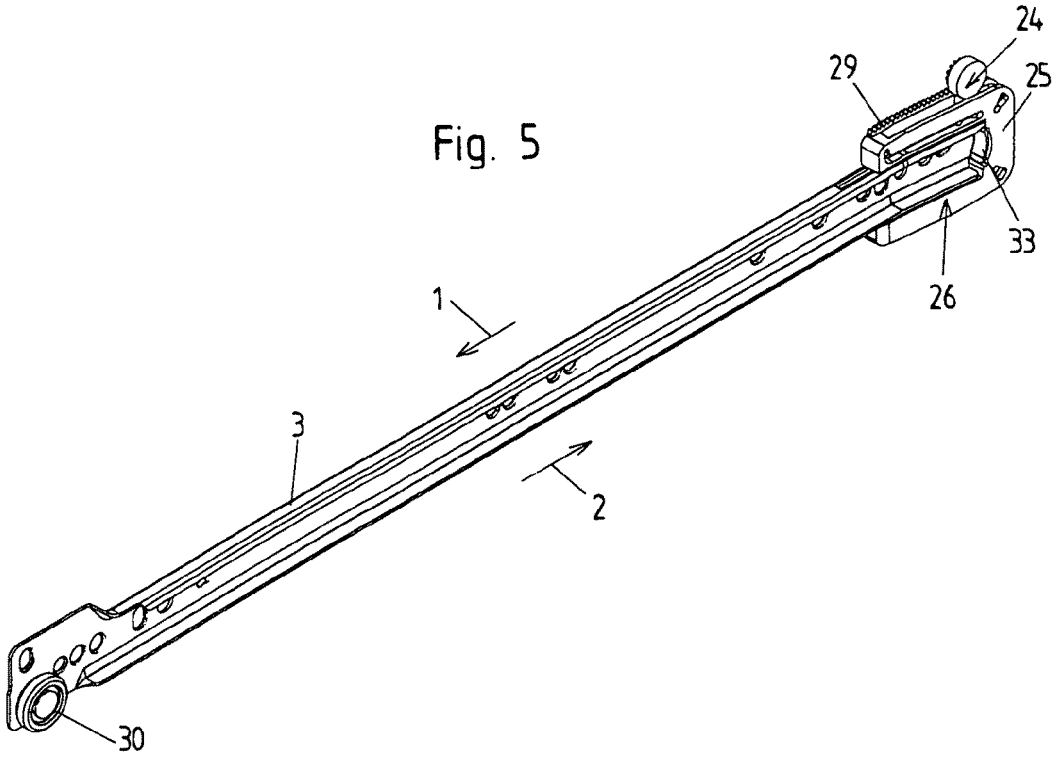
Figure 6:
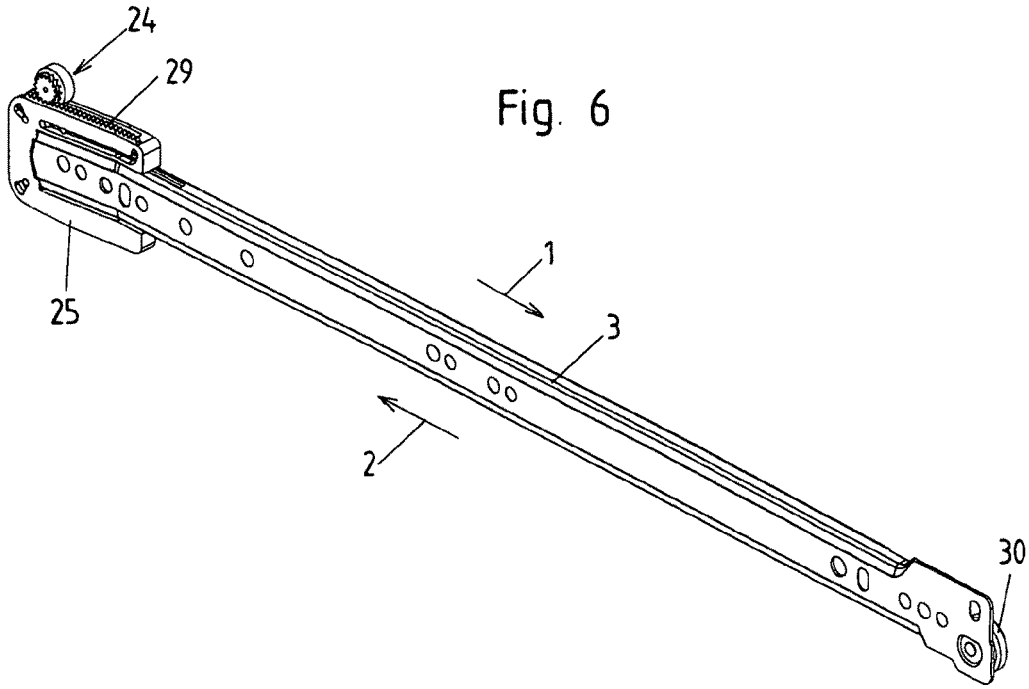

FIGS. 5 and 6 show once again separately the guide or body rail 3 of this embodiment example. In FIG. 6 is especially clearly visible that the guide rail 3, viewed in the slide-in direction 2, is angled-off in its rearward end region 27, wherein, as can be seen in FIGS. 1 and 2, the roller 4 can move into this end region 27. Through this downwardly directed bending-off of the guide rail 3 in the operating position, the gravity of the self-retraction device 5 aids in moving the roller 4 or the entire second rail 8 into its end position depicted in FIGS. 1 and 2. In this end position, the roller 4 is advantageously in contact on end stop 33 in housing 25. In FIGS. 5 and 6 can also be seen clearly the manner in which the further roller 30 is rotatably fixed on the forward end, seen in the slide-in direction 2, of guide rail 3 by means of an appropriate roller pivot axle.

Figure 9:
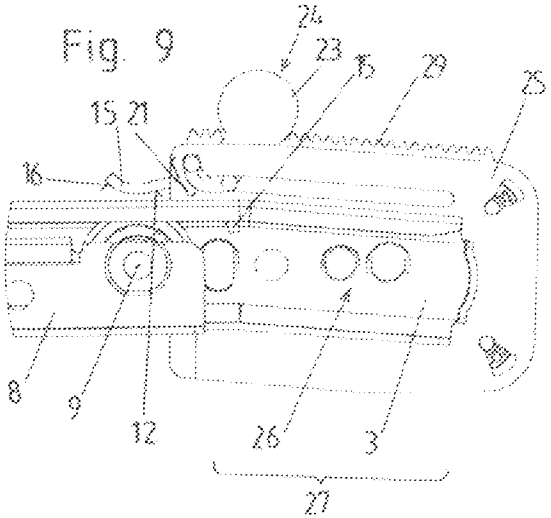
Figure 8:
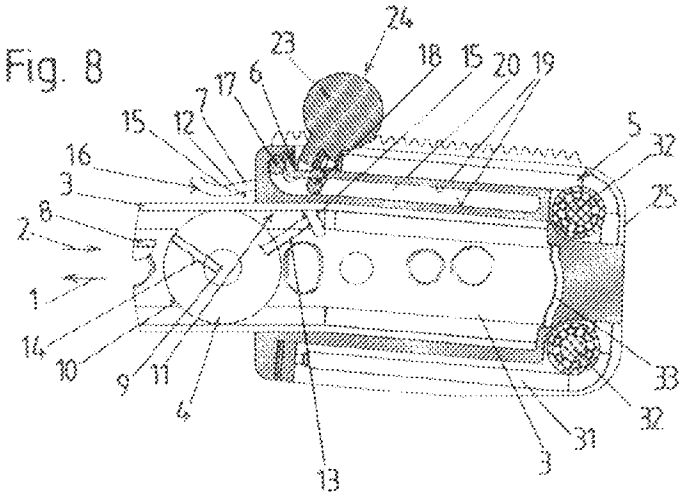
Figure 11:
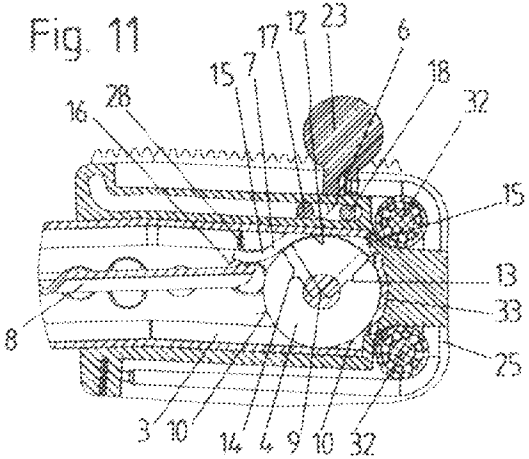
Figure 7:
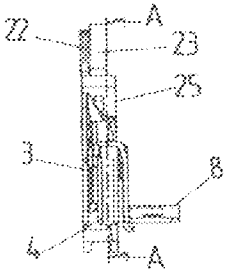
Figure 10:
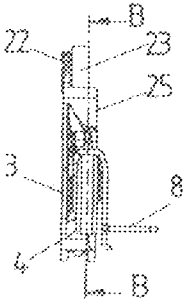

The self-retraction device 5 of the first embodiment example implemented according to the invention will now be explained in further detail in conjunction with FIGS. 7 to 12. FIG. 8 shows a section along section line AA depicted in FIG. 7, wherein the tilt slide 6 is located in its forward position, viewed in the slide-in direction 2, in which position it receives roller 4 or grips roller 4 with the claw 7. FIG. 9 shows the same condition as in FIG. 8, however in a non-sectioned side view. FIG. 11 shows a sectional representation along section line BB shown in FIG. 10, wherein here the self-retraction device 5 is shown in the end position in which the roller 4, and therewith the second rail 8, is completely retracted in the slide-in direction 2. The roller 4 is accordingly in contact on end stop 33. FIG. 12 shows again a non-sectioned side view of this situation.

The tilt slide 6 or its claw 7 provided in this automatic retraction mechanism or self-retraction device 5 comprises two claw arms 15. These delimit an indentation 11 serving for receiving the roller 4. The claw face 12 in the depicted embodiment is at least sectionwise curved in the form of a circle. The claw 7 engages with the claw face 12 on the running surface 10 of roller 4. The radius of curvature 13 of the circular section of claw face 12 is between 100% and 110%, preferably between 100% and 105%, of the radius 14 of running surface 10 of roller 4. Consequently, as explained above, a certain play can be provided between roller 4 and claw 7, without such play decreasing the operational reliability of the self-retraction device 5.

Figure 12:
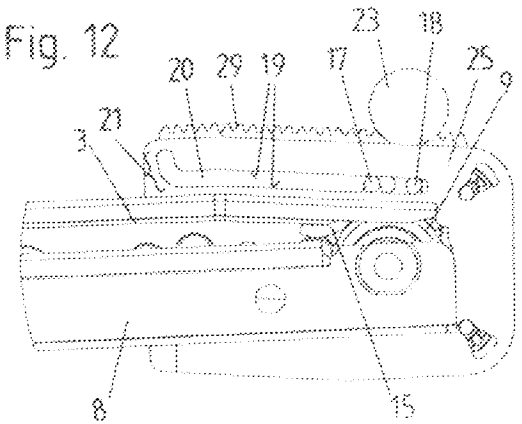

In this embodiment, the tilt slide 6 comprises two guide pins 17 and 18 spaced apart in the pull-out direction 1. With these pins the slide is guided displaceably by force in a guide track 20 of a housing 25. In the depicted embodiment, the guide track 20 is formed in the shape of a groove and is delimited by two opposing side walls 19. On its forward end, viewed in the slide-in direction 2, the guide track 20 has an angled-off or bent-out section 21, it otherwise advantageously extends linearly. Into the angled-off section 21 can be slid a first guide pin 17, here the guide pin forward in the slide-in direction 2. The second guide pin 18 provided in this embodiment forms a swivel axle about which the tilt slide 6 swivels when the first guide pin 17 is slid into the angled-off section 21. As a result of this swivel movement, the tilt slide 6 comes into the ready position shown in FIGS. 8 and 9, in which the roller 4 can run into the indentation 11 of the claw 7. When it does so and abuts against the arm 15 which, when viewed in the slide-in direction 2, is the rearward arm, the tilt slide 6 is shifted in the slide-in direction 2 and in doing so is tilted back, whereby it no longer is held by means of the pin 17 in the angled-off section 21. This makes it possible that spring 31 under tension retracts the tilt slide 6 together with roller 9 and the second rail 8 secured thereon in the slide-in direction 2 until the end position depicted in FIGS. 11 and 12 is reached. The spring 31 in the embodiment depicted here is deflected twofold in housing 25 by means of the spring deflection rollers 32 in order to realize as long a spring excursion as possible. One end of spring 31 engages on tilt slide 6. The opposite end of spring 31 is secured on housing 25. During the described shifting movement, the tilt slide 6 is guided in the guide track 20 by force via its guide pins 17 and 18.

As already explained above, the attenuator 24 with its attenuator part 23 (here the attenuator housing) is secured integrally on tilt slide 6. This effects for the automatic retraction movement carried out by spring 31 to be simultaneously attenuated by attenuator 24. This results overall in a gentle braking of the retraction movement such that the roller 4, the rail 8 and the furniture part secured thereon are decelerated gently and not abruptly upon reaching the end stop 33. In the depicted embodiment, the attenuator part 22, rotatably supported relative to the attenuator part or the attenuator housing 23, meshes with the toothed rack 29. Further details regarding attenuator 24 do not need to be depicted, since they are known within the prior art. For the sake of completeness, reference is made to the fact that the attenuator 24, of course, does not absolutely need to be disposed integrally on the tilt slide 6.

In the event that the tilt slide 6 for once does not reach the end position shown in FIGS. 11 and 12 without the roller 4 being located in the indentation 11, a so-called malfunction safety is provided in the depicted embodiment example, This safety comprises that at least one (in the depicted embodiment, the one that is forward in the slide-in direction 2) claw arm 15 is elastically deformable and includes a run-up face 16 oblique with respect to the slide-in direction 2. The roller 4, by running up against the oblique run-up face 16 and through elastic deformation of the claw arm 15, can be shifted past the latter into the indentation 11 of the claw 7. The movement or the bending of the claw arm 15 herein is illustrated by the double arrow 28 in FIG. 11.

Figure 13:
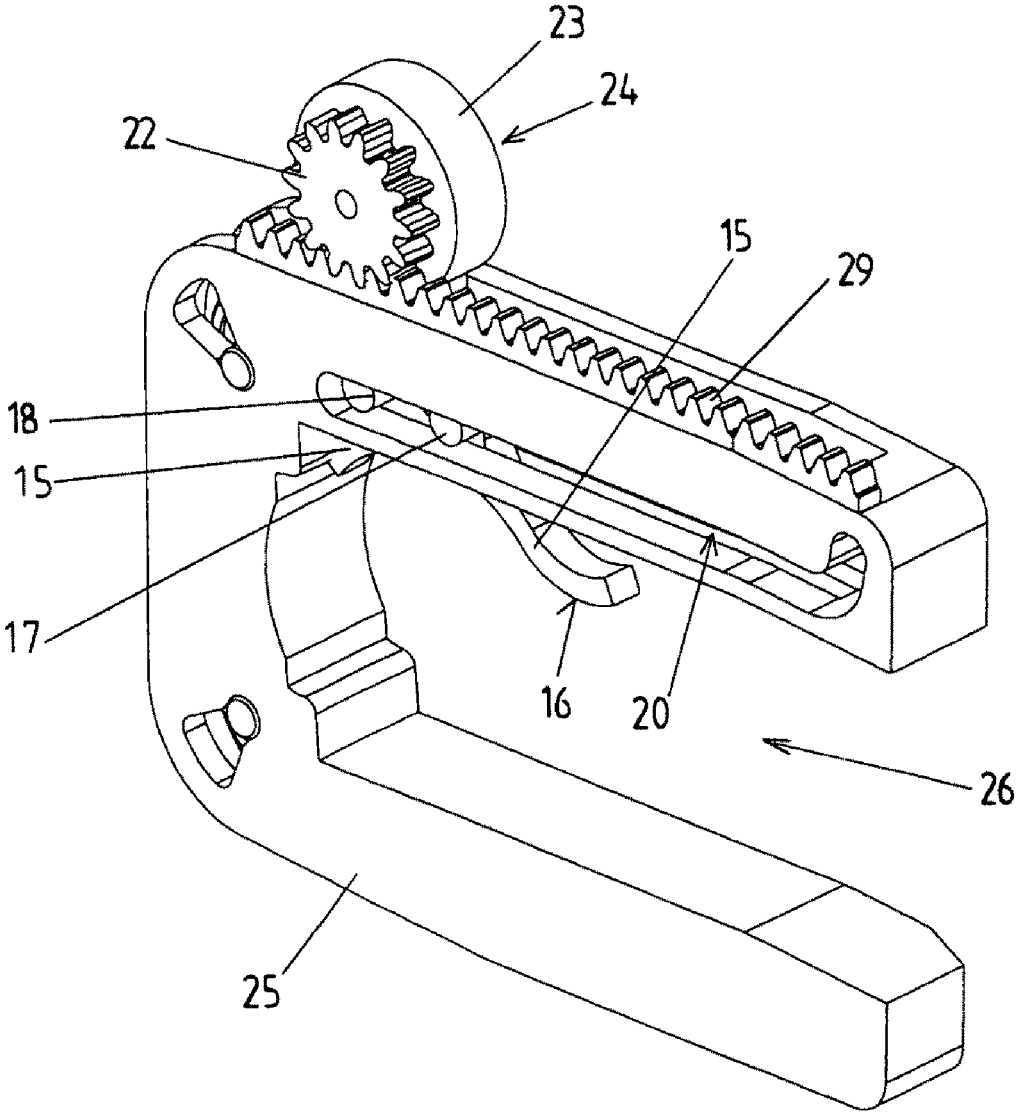

FIG. 13 shows the housing 25 without the guide rail 3. In this depiction, it is especially clearly evident that the housing 25 includes a U-shaped recess 26 in which the guide rail in the depicted embodiment is supported with that end, which, viewed in the slide-in direction 2, is the rearward end. The housing 25 is advantageously realized to be elastically resilient, such that it can be snapped onto the guide rail 3. At an appropriate layout, in this manner a simple mounting of the housing 25 on the guide rail 3 is made possible.

FIGS. 14 to 24 show a second embodiment example according to the invention of a roller pull-out guidance. This equals or resembles in numerous parts the first embodiment example. However, there are differences in the type and linkage of the utilized attenuator 24 and in the concrete physical form of the tilt slide 6 engaging according to the invention on roller 4. The subsequent description is concentrated on the explanation of the differences from the first embodiment example. The not further elucidated details can be implemented as in the first embodiment variant.

Figure 14:
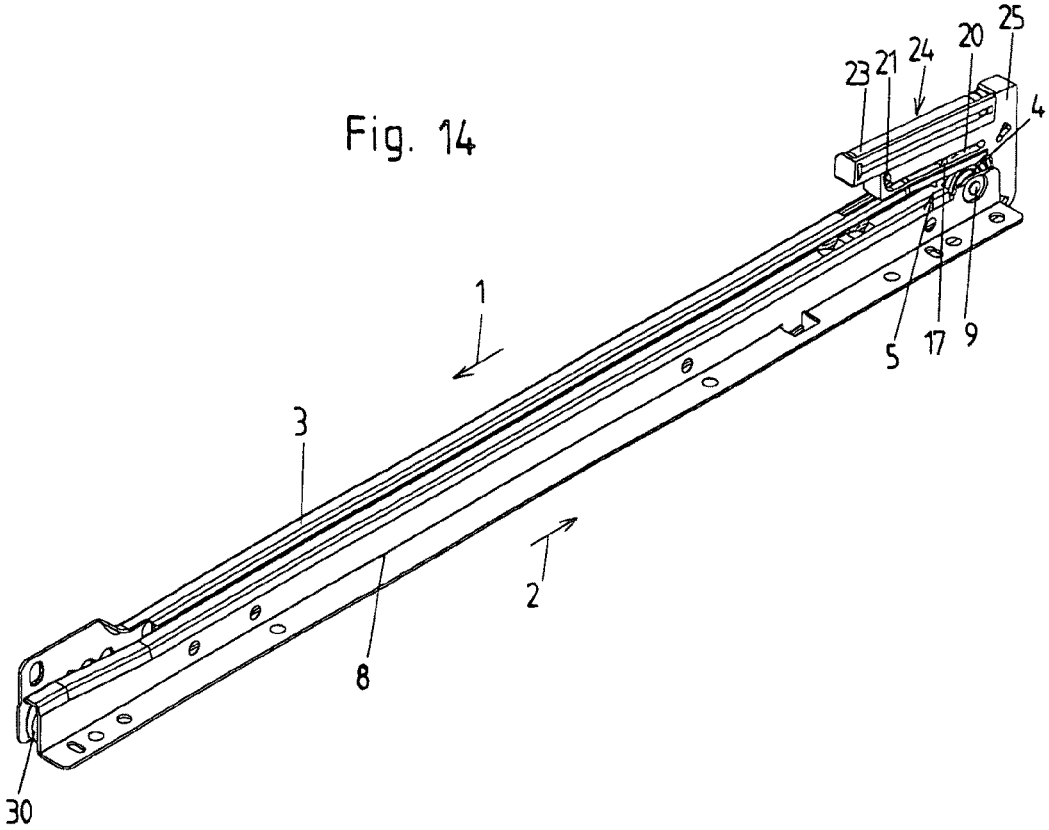
FIGS. 14 to 24 show a second embodiment example according to the invention.
Figure 15:
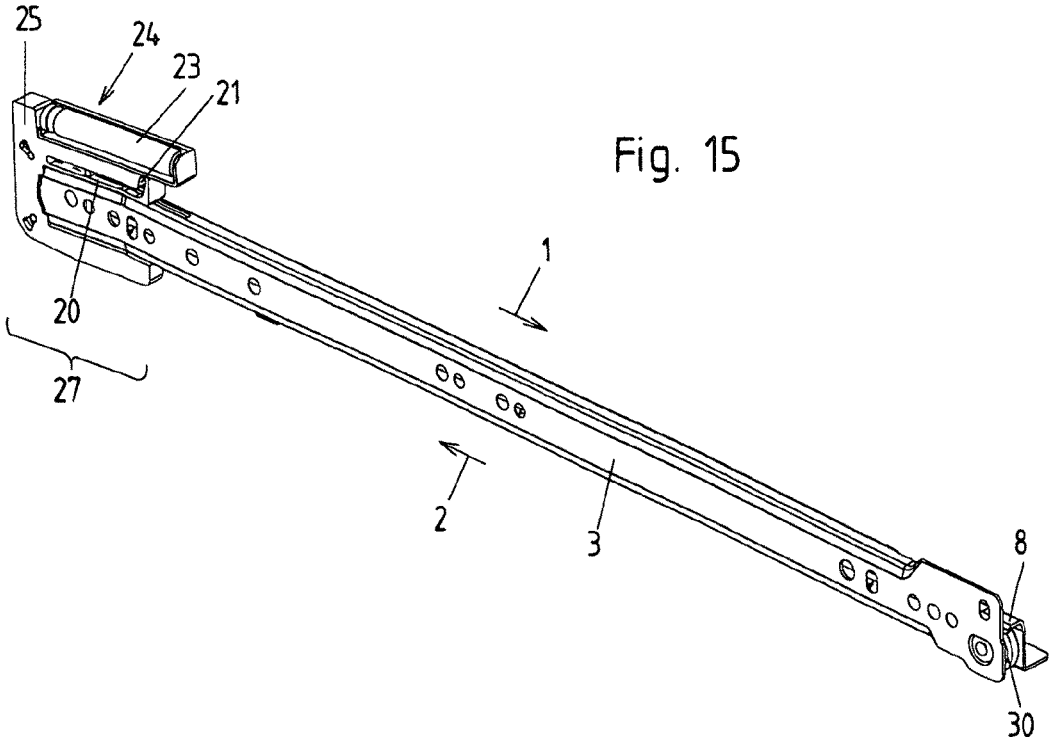
Figure 16:
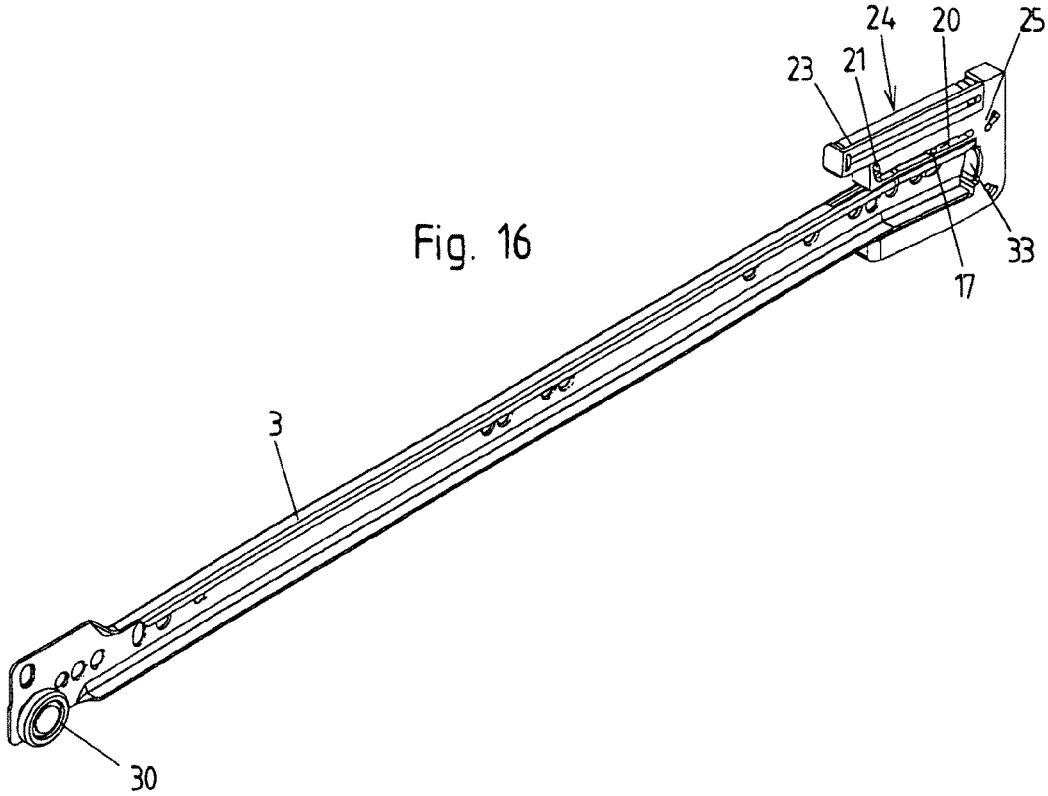
Figure 17:
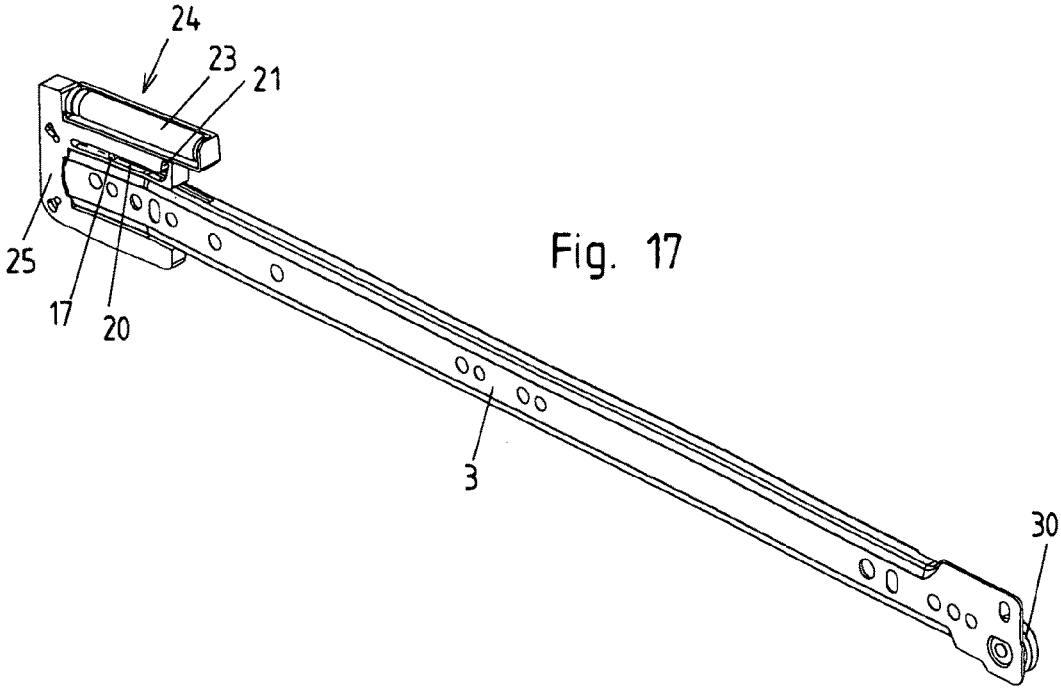
Figure 20:
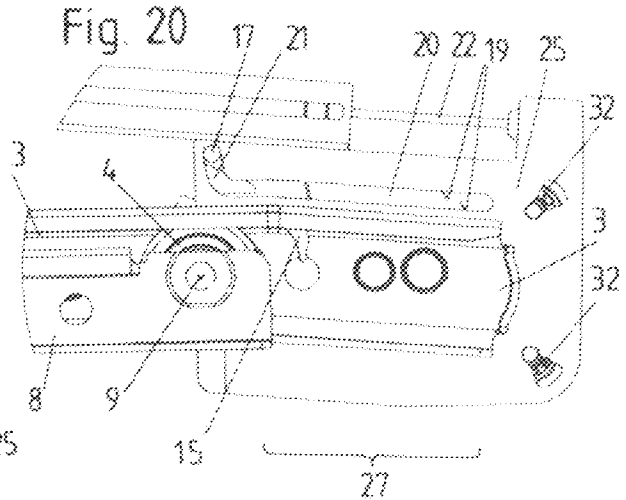
Figure 23:
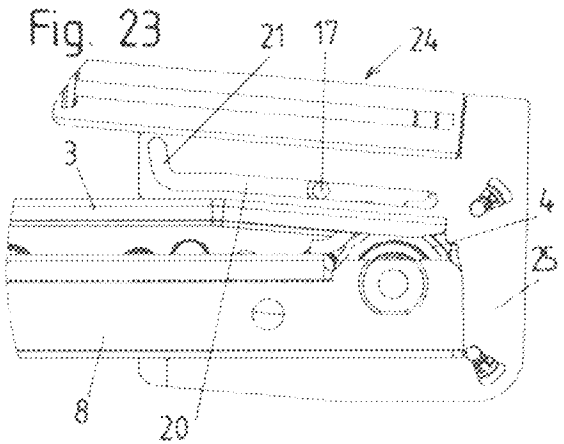
Figure 19:
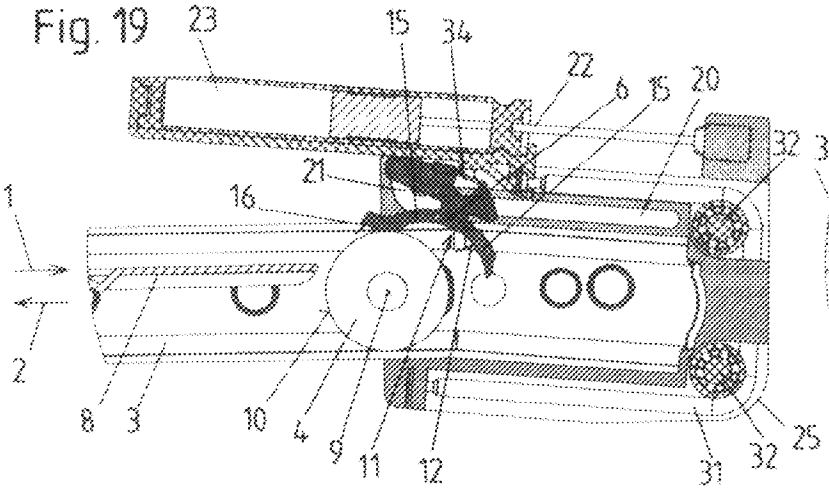
Figure 22:
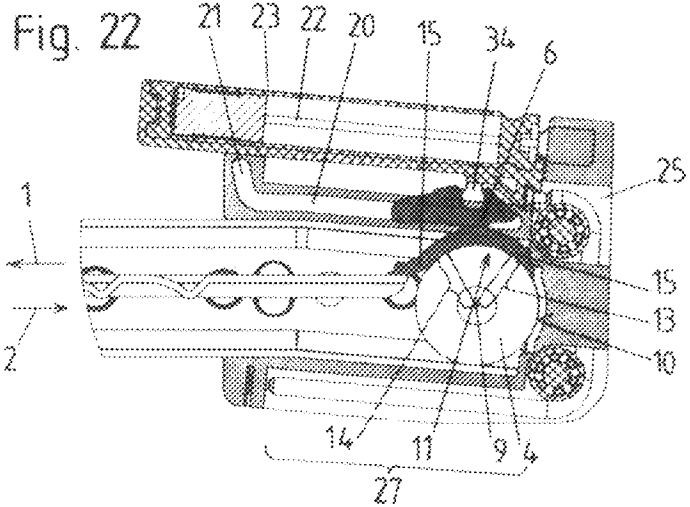
Figure 18:
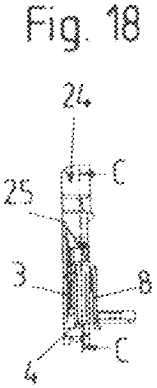
Figure 21:
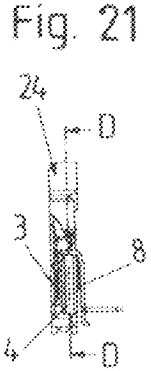

FIGS. 14 and 15 show, first, once again views of this embodiment of the roller pull-out guide from two sides. The second rail 8 can be implemented entirely as in the first embodiment and is not shown here again. With respect to rail 8, thus reference is made to FIGS. 3 and 4. The guide or body rail 3 is shown without a second rail 8 in FIGS. 16 and 17. The essential differences between it and the first embodiment will be explained in conjunction with FIGS. 18 to 23. FIG. 19 shows again the section according to FIG. 18 along the section line CC. FIG. 20 shows a side view onto this embodiment in the position according to FIG. 19. FIG. 22 shows the section along line DD in FIG. 21. Here the roller 9 and the second rail 8 are completely retracted. FIG. 23 shows the corresponding side view. A first difference from the first embodiment is that, instead of the rotation attenuator shown there, a linear attenuator 24 known per se is utilized. This linear attenuator comprises two attenuator parts 22 and 23 that are movable relative to one another. In the depicted embodiment, reference number 22 denotes a piston rod 22 known per se, with the piston disposed thereon. This piston is supported linearly displaceable in the second attenuator part 23 or the attenuator housing. The physical form of the piston of attenuator 24 does not need to be further explained. Diverse variants are known in prior art. Linking the attenuator 24 to the tilt slide 6 in this embodiment example takes place via a swivel joint 34 which forms simultaneously the pivot axle or swivel axle about which the tilt slide 6 can be swivelled. Accordingly, the tilt slide 6 in this embodiment also requires only one guide pin 17, which, again, is guided in the guide track 20. By guiding the guide pin 17 into the angled-off section 21 of the guide track 20 and by pulling the guide pin 17 out of this section, the tilting of the tilt slide is completed. FIGS. 19 and 20 show again the position of the tilt slide, in which it receives the roller 4 into its indentation 11. FIGS. 22 and 23 show the end position in which roller 4 or second rail 8 are completely retracted. The retraction process from the position shown in FIGS. 19 and 20 into the position shown in FIGS. 22 and 23, again takes place by means of spring 31. The countermovement in the pull-out direction 1 can in both embodiments take place, for example, manually by pulling on the movable furniture part, not shown here, wherein subsequently, again by shifting the tilt slide 6 into the position shown in FIGS. 19 and 20, the spring 31 is put under tension for the next automated retraction process.

Figure 24:
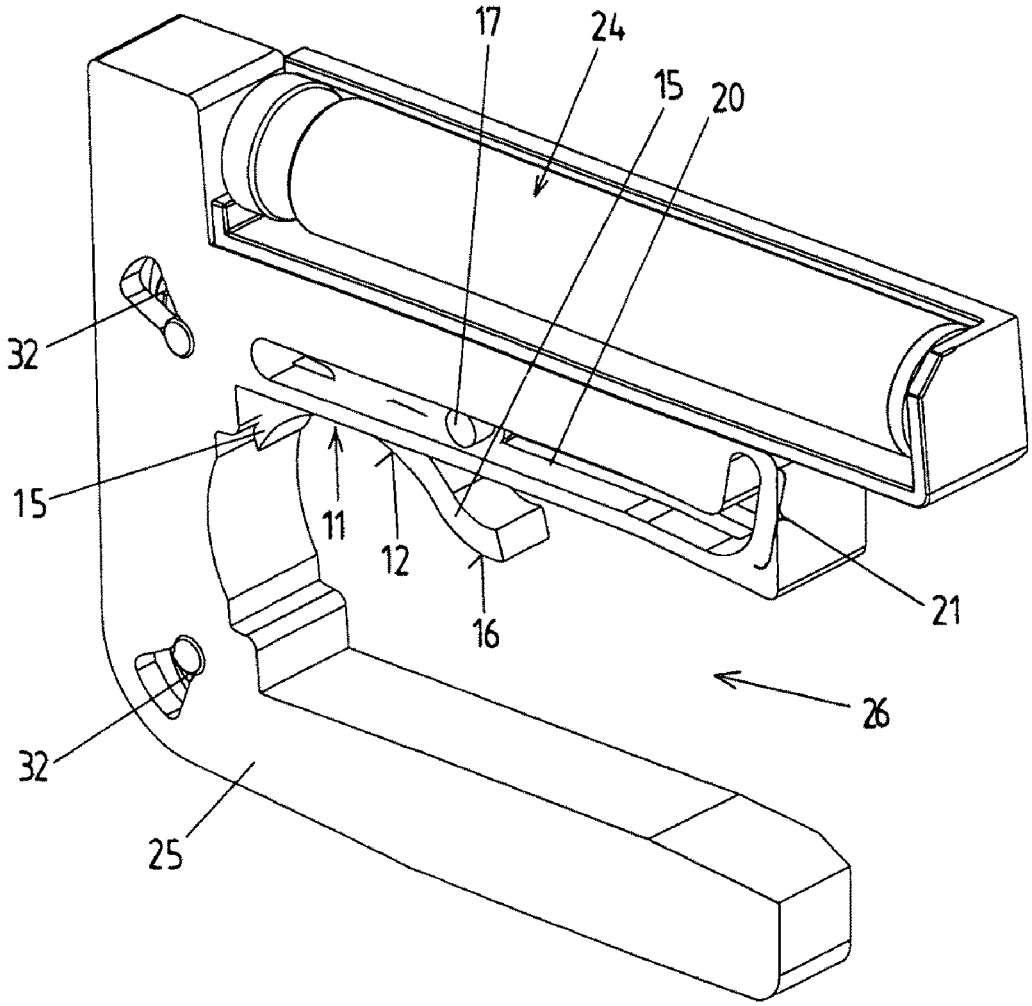

The housing 25 of this embodiment is once again shown separately in FIG. 24. It is here also formed in the shape of a U and includes recess 26 into which the guide rail 3 can be slid. In this embodiment example the thus formed housing 25 is also preferably snapped onto the guide rail 3.

In the two embodiments according to FIGS. 1 to 24, the contacting process as well as also the retraction process is carried out via the engagement of claw 7 of the tilt slide 6 on roller 4. As explained above, this does not necessarily need to be the case. In FIGS. 25 to 36, an embodiment according to the invention is shown, in which only the contacting process for the retraction of the furniture part is realized by engagement of claw 7 on roller 4.

In the succeeding description of this embodiment example in conjunction with FIGS. 25 to 36 essentially only the differences between this example and the two previously described embodiment examples are discussed. Features of the third embodiment not explained in detail can be implemented as described in the first two embodiment examples.

Figure 25:
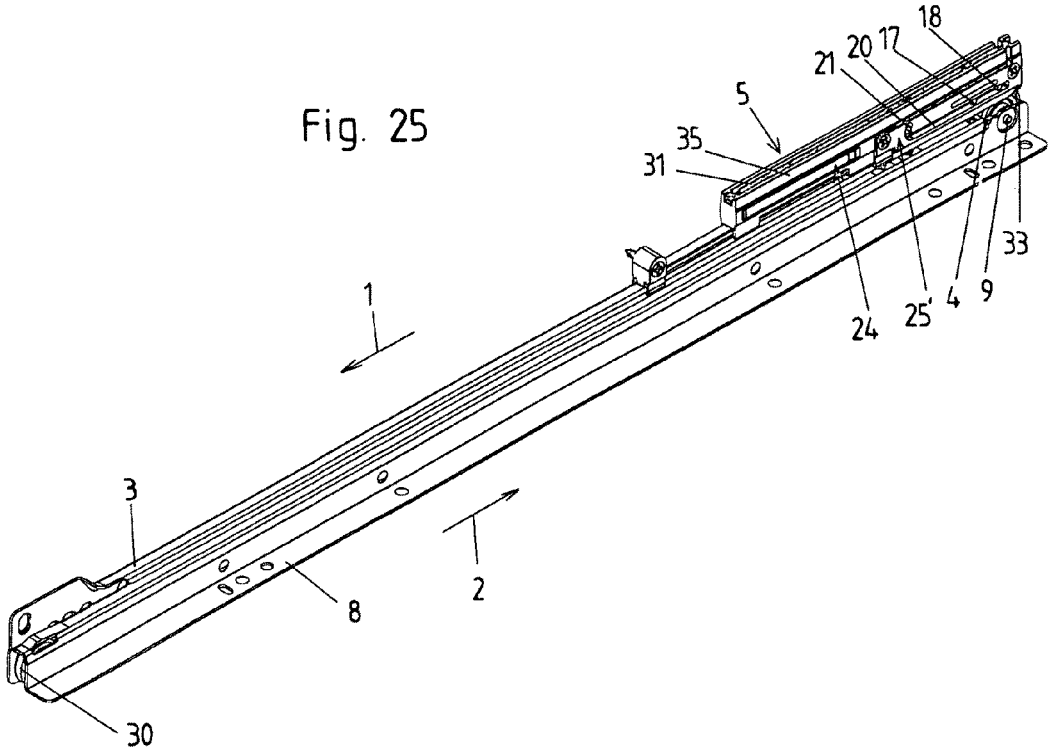
FIGS. 25 to 36 show a third embodiment example according to the invention.
Figure 26:
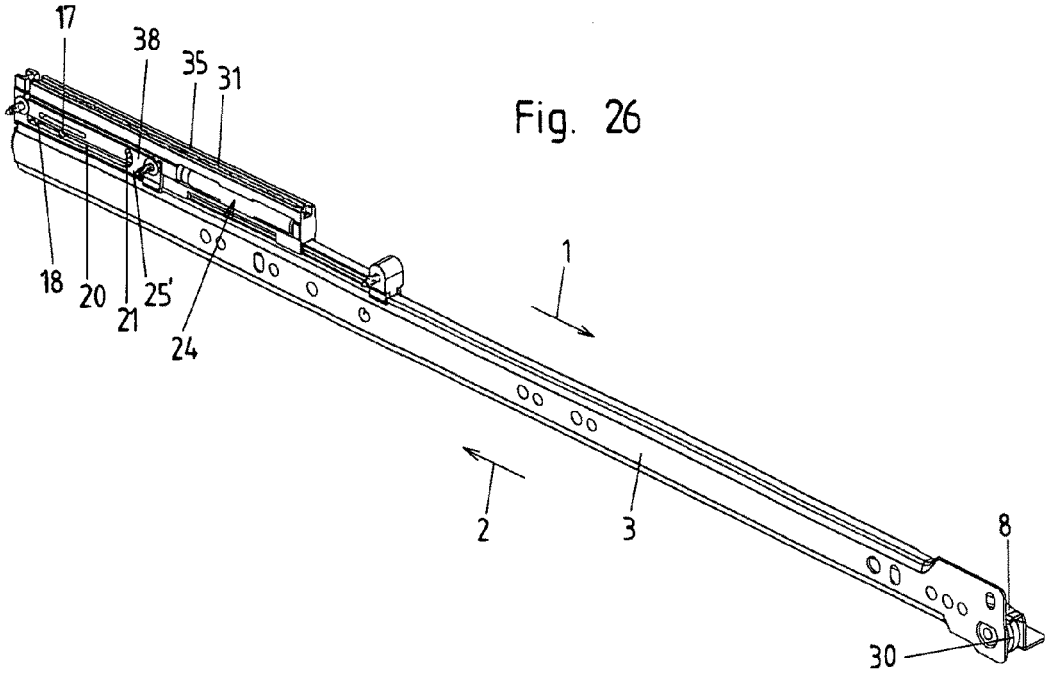
Figure 27:
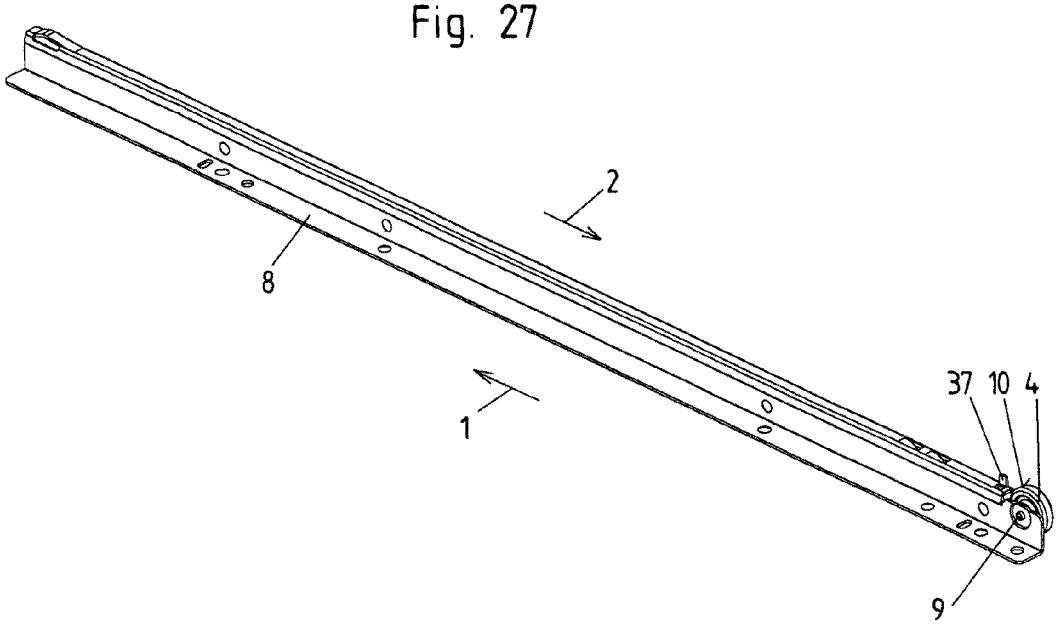
Figure 28:
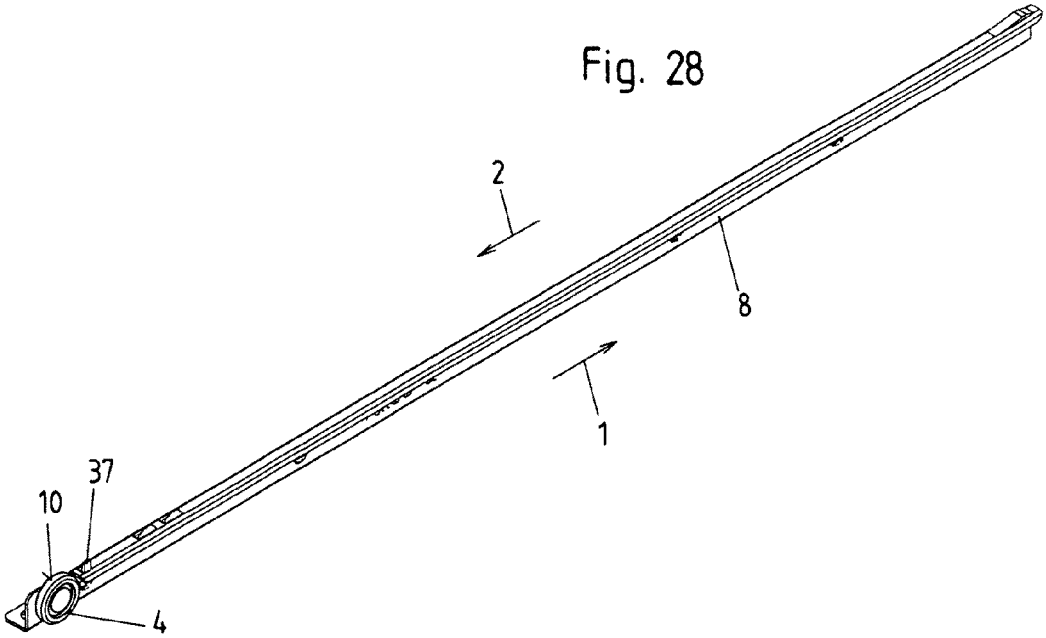
Figure 29:
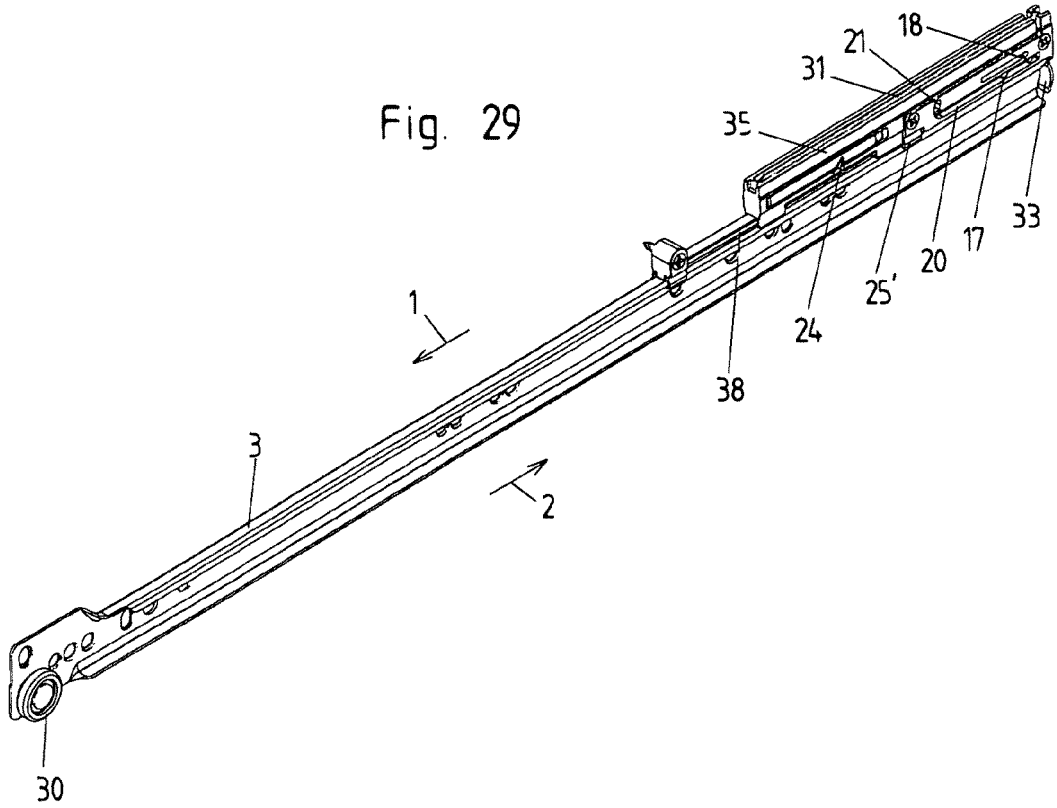
Figure 30:
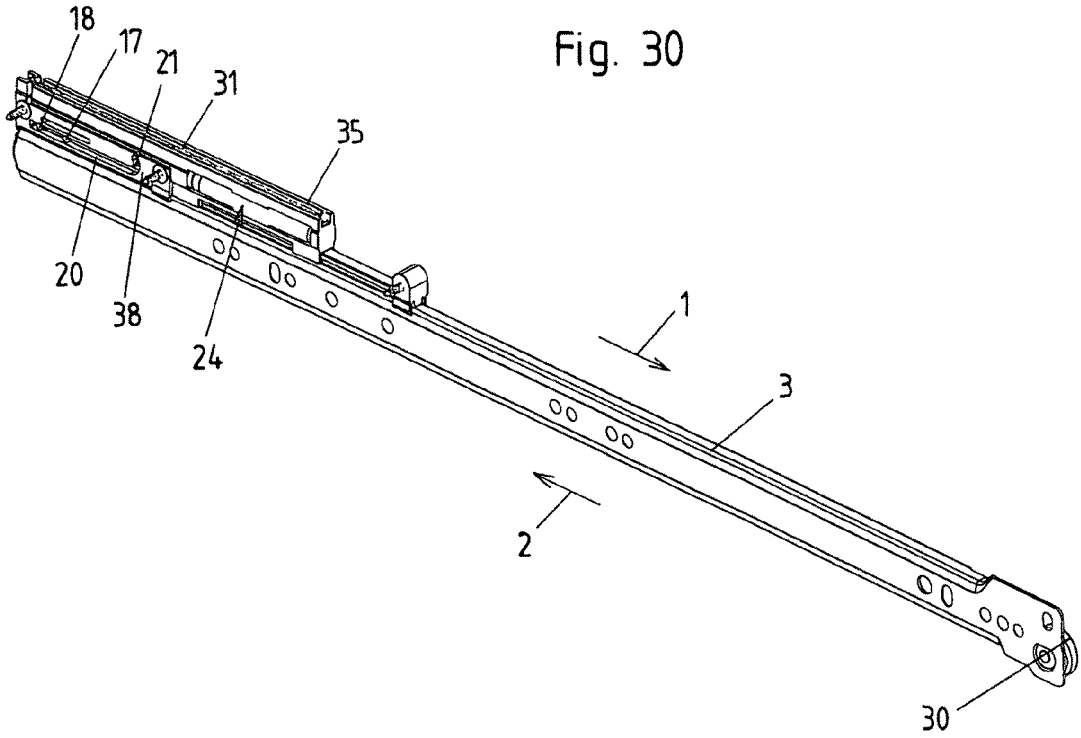
Figure 31:
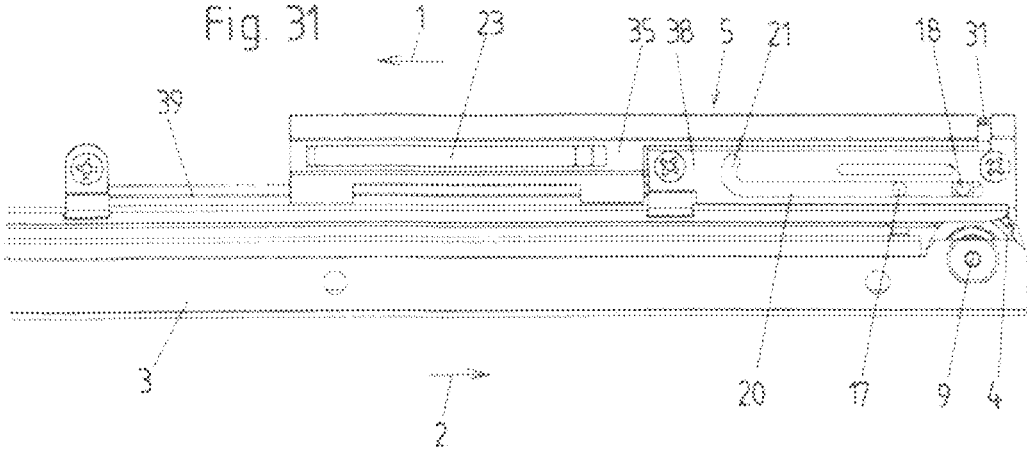
Figure 32:
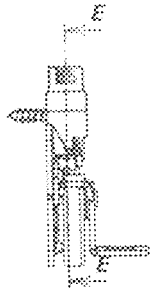
Figure 33:
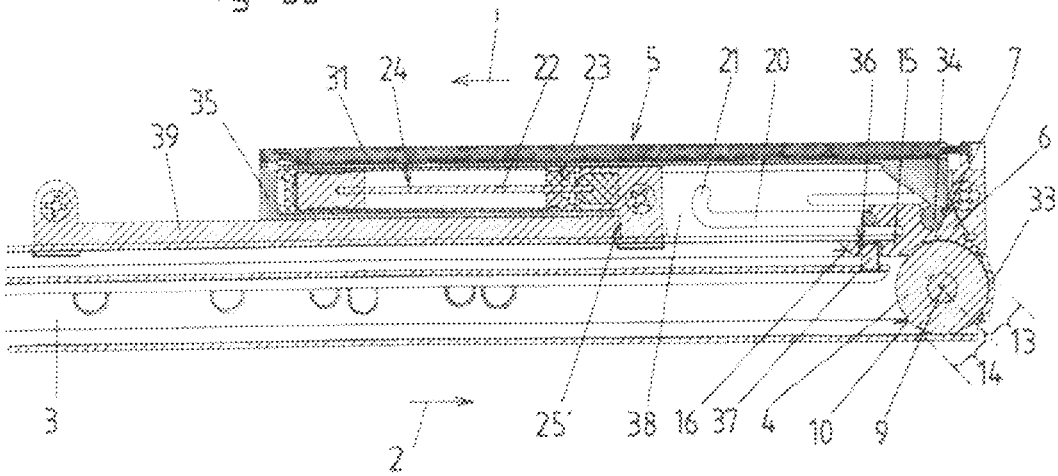
Figure 34:
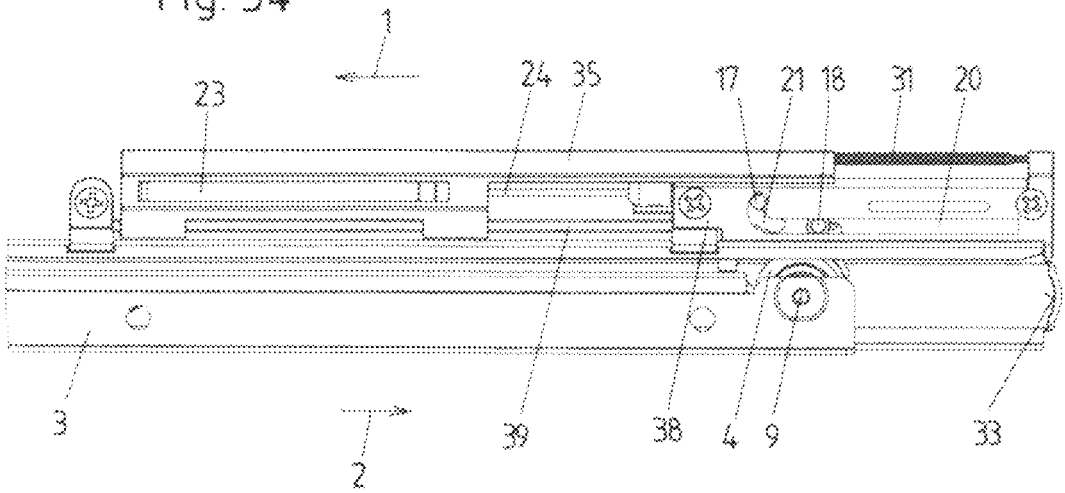
Figure 35:
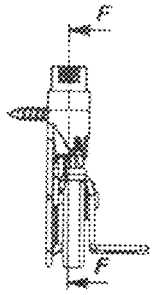
Figure 36:
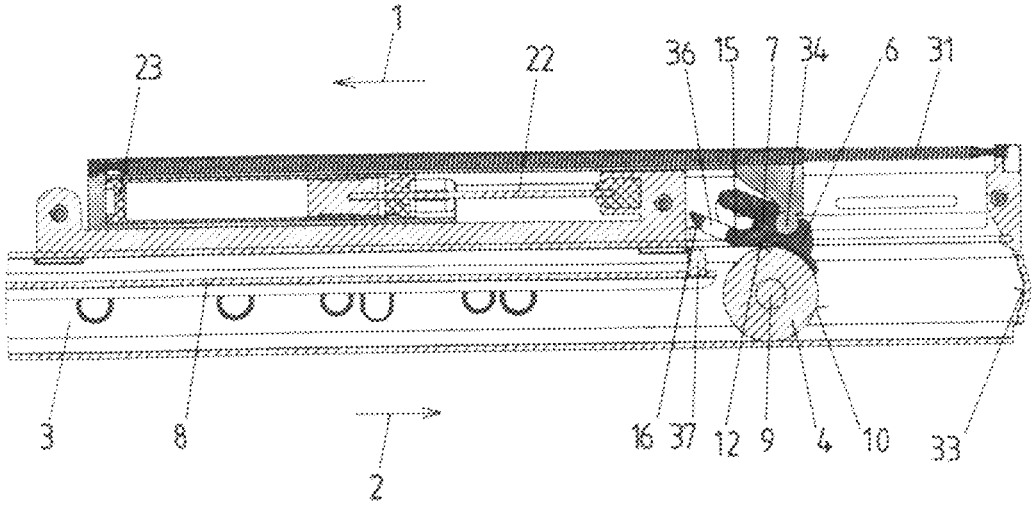

FIGS. 25 and 26 show perspective depictions of the entire roller pull-out guidance, wherein the second rail 8 is slid completely in the slide-in direction 2 into guide rail 3. FIGS. 27 and 28 show perspective depictions of the second rail 8. FIGS. 29 and 30 show perspective depictions of guide rail 3 with self-retraction device 5 disposed thereon, with the second rail 8 removed. FIGS. 31 to 33 show depictions as in FIGS. 25 and 26, however only in the rearward region of guide rail 3, in which the self-retraction device 5 is also disposed. FIG. 31 shows a side view, FIG. 32 the location of section line EE and FIG. 33 the longitudinal section along section line EE. In FIGS. 31 to 33 the second rail 8, and therewith also roller 4, is in the completely slid-in state in the slide-in direction 2. FIGS. 34 to 36 show in depictions, otherwise analogous to FIGS. 31 to 33, the situation in which the roller 4 at the start of the contacting process during the slide-in process in the slide-in direction 2 strikes the claw 7, or also the situation in which during the pulling-out in the pull-out direction 1 the tilt slide 6 is already located again in the first tilt position or stand-by position, such that the roller 4 is no longer held and the second rail 8 can be pulled out further in the pull-out direction 1.

A first significant difference from the first two embodiments is that in the third embodiment, the housing 25' of this embodiment does not have a U-shaped recess 26 but rather, is disposed, preferably completely, above the guide rail 3, viewed in an operating position of the roller pull-out guidance. It is understood that it could just as well be disposed, preferably completely, beneath the guide rail 3. Both variants have the advantage that overall the installation length of the roller pull-out guidance is shortened since the housing 25' no longer projects at the rearward end over guide rail 3. In the course thereof, in the depicted embodiment is also provided that the spring 31, which provides the force for retracting roller 4 or second rail 8, is no longer deflected. In the depicted embodiment the spring 31 has an exclusively linear extent. Spring 31 is therein, preferably exclusively, disposed above the guide rail 3. It also does not project over the guide rail 3 in the slide-in direction 2. The spring 31 can just as well as, preferably exclusively, be disposed beneath the guide rail 3.

Housing 25' of self-retraction device 5 of this embodiment is built of two parts. It comprises a housing part 38 nondisplaceably fixed on the guide rail 3. This housing part in this embodiment includes again a housing rail 39, on which a connection body formed as a push rod 35 is supported displacebly relative to the fixed housing part 38, preferably parallel to the pull-out direction 1 or slide-in direction 2. As is evident in particular in sectional representations according to FIGS. 33 and 36, the tilt slide 6 of this embodiment is disposed via the swivel joint 34 on the connection body formed as a push rod 35. This type of disposition leads to the fact that the tilt slide 6 and the push rod 35 are forcibly coupled with one another in the pull-out direction 1 or slide-in direction 2, and a displacement of the push rod 35 thus leads by necessity to a corresponding displacement of the tilt slide 6 and conversely. Next to the tilt slide 6 in the third embodiment-on the connection body or the push rod 35 also an attenuator part is fixed of the attenuator 24, here implemented as a linear attenuator.

In the depicted embodiment involved here is the attenuator part 23 which forms the cylinder of attenuator 24. In this cylinder is displaceably supported the piston which is fixed on the other attenuator part 22 implemented as a piston rod. The attenuation process of attenuator 24 takes place by sliding the attenuator part 23 onto the piston rod or the attenuator part 22, at least during a portion of the retraction process in the slide-in direction 2. It is understood that the attenuator can also be realized such that it attains a movement attenuating effect in the pull-out direction.

As in the first embodiments, the tilt slide 6 is guided by means of the first guide pin 17 and of the swivel axle pin 18 in a guide track 20, which includes at its forward end, viewed in the slide-in direction 2, the angled-off region 21. Guidance and tilting of tilt slide 6 by means of guide track 2 and its angled-off section 21 takes place as in the two first described embodiments. The tilt movement takes place in the swivel joint 34.

In FIG. 36 the tilt slide 6 with its claw 7 is in standby position or in the first tilt position. In this position the roller can run up onto the claw face 12 of claw 7 of tilt slide 6 through the corresponding sliding-in of the second rail 8 in the slide-in direction 2. The claw 7 of tilt slide 6 hereby engages on roller 4, in the depicted embodiment specifically on its running surface 10. Through the further sliding-in of roller 4 results the contacting process in which the tilt slide 6 is tilted from its first tilt position or the stand-by position according to FIG. 36 about the pivot axle of swivel joint 34 into its second tilt position. The second tilt position is evident for example in FIG. 33. In the third embodiment, upon the tilting of the tilt slide 6 from the first tilt position into the second tilt position, in contrast to the first two embodiment examples, there occurs engagement of the coupling part 36, disposed on the tilt slide or its claw arm 15, with the second coupling part 37 disposed on the second rail 8. In the depicted embodiment example the first coupling part 36 is a corresponding recess in the forward claw arm 15 of claw 7 viewed in the slide-in direction 2. The second coupling part 37 is formed in the depicted embodiment example by a pin disposed on the second rail 8. The coupling parts 36 and 37 can, of course, in contrast to the depicted embodiment, also be disposed inversely on tilt slide 6 and second rail 8. It is understood that other mechanical or, for example also magnetic or electric, coupling parts can be provided. Through the engagement of the two coupling parts 36 and 37 into one another, the second rail 8 is caught via the coupling parts directly on tilt slide 6. In the subsequent retraction process by means of spring 31 in the slide-in direction 2, the force transmission in this embodiment example in this case takes place directly via the coupling parts 36 and 37, whereby during the retraction process the roller 4 or its running surface 10 is no longer directly in contact on claw face 12 of claw 7 and thereby friction losses during the retraction process are minimized or entirely avoided.

FIGS. 31 to 33 show the completely retracted position in which the roller 4 is in contact on the end stop 33 of guide rail 3. The two coupling parts 36 and 37 in this position also continue to be in engagement with one another. If now on the second rail 8 or on a movable furniture part secured thereon, pulling in the pull-out direction 1 occurs, the tilt slide 6, via the coupling parts 36 and 37 directly caught on the second rail 8, is simultaneously moved in the pull-out direction 1 such that, after a path determined by the length of the straight section of guide track 20, the first guide pin 17 enters in the guide track 20 disposed on the fixed housing part 38 into the angled-off section 21. Through the further guidance of the first guide pin 17 into the angled-off section 21, subsequently a tilt movement takes place of tilt slide 6 back into the first tilt position or into the stand-by position according to FIG. 36, in which the engagement between the coupling parts 36 and 37 becomes detached and the roller 4 is released by claw 7, such that subsequently the roller 4 together with the second rail 8 can be further pulled out in the pull-out direction 1. During the movement of the tilt slide 6 from the position in FIG. 33 into the position according to FIG. 36 the spring 31 is again placed under tension for the next retraction process.

Further mentioned should be the oblique run-up face 16 of the forward claw arm 15, seen in the slide-in direction 2, of tilt slide 6. This face, analogous to that described in the first two embodiment examples, serves for the so-called malfunction safety, in which the roller 4 in the second tilt position of tilt slide 6, by running up against the oblique run-up face 16 and through the elastic deformation of claw arm 15, is displaceable past this arm into the indentation 11 of claw 7.

This application claims priority to Austrian application A 1565/2008, filed Oct. 7, 2008, and European patent application 09 007 350.3, filed Jun. 3, 2009. The entire subject matter of these two foreign priority applications is incorporated herein by reference.

LEGEND TO THE REFERENCE NUMBERS

1 Pull-out direction
2 Slide-in direction
3 Guide rail
4 Roller
5 Self-retraction device
6 Tilt slide
7 Claw
8 Second rail
9 Roller pivot axle
10 Running surface
11 Indentation
12 Claw face
13 Radius of curvature
14 Radius
15 Claw arm
16 Oblique run-up face
17 First guide pin
18 Swivel axle pin
19 Side wall
20 Guide track
21 Angled-off section
22 Attenuator part
23 Attenuator part
24 Attenuator
25, 25' Housing
26 U-shaped recess
27 End region
28 Double arrow
29 Toothed rack
30 Further roller
31 Spring
32 Spring deflection roller
33 End stop
34 Swivel joint
35 Push rod
36 First coupling part
37 Second coupling part
38 Fixed housing part
39 Housing rail

The invention claimed is:

1. A roller pull-out guide for pulling out a furniture part from a furniture body in a pull-out direction and for sliding the furniture part into the furniture body in a slide-in direction, comprising:

at least one guide rail;

at least one roller guided in the guide rail; and a self-retraction device with a spring-loaded, tiltably and displaceably supported tilt slide for retracting the furniture part in the slide-in direction;

wherein the tilt slide is displaceable in the slide-in direction, and includes a claw which engages on the roller for the retraction of the furniture part in the slide-in direction; and wherein the roller has a running surface with which the roller runs in the guide rail.

2. The roller pull-out guide as claimed in claim 1;

wherein the roller is rotatably supported or rotatably secured on a second rail of the roller pull-out guide.

3. The roller pull-out guide as claimed in claim 2;

wherein the roller is supported or secured on the second rail at its, viewed in the pull-out direction, rearward end.

4. The roller pull-out guide as claimed in claim 1;

wherein the claw of the tilt slide engages on the running surface of the roller.

5. The roller pull-out guide as claimed in claim 1;

wherein the claw has a claw face with which it engages on the roller or on the running surface of the roller.

6. The roller pull-out guide as claimed in claim 5;

wherein the claw face engages on the running surface of the roller; and wherein the length of the claw face, measured in the pull-out direction, is at least one eighth or at least one fourth of the total circumference of the running surface of the roller.

7. The roller pull-out guide as claimed in claim 5;

wherein the claw face is at least sectionwise curved.

8. The roller pull-out guide as claimed in claim 5;

wherein the claw face delimits an indentation in the claw.

9. The roller pull-out guide as claimed in claim 5;

wherein the claw face is at least sectionwise curved in the form of a circular arc; and wherein the radius of curvature of the circular arc-shaped section of the claw face is between 100% and 110% or between 100% and 105% of a radius of the running surface of the roller.

10. The roller pull-out guide as claimed in claim 1;

wherein the claw has an indentation for receiving the roller, the indentation being delimited by two claw arms.

11. The roller pull-out guide as claimed in claim 10;

wherein the claw arms are curved.

12. The roller pull-out guide as claimed in claim 10;

wherein at least one of the claw arms is elastically deformable, and includes an oblique run-up face which is oblique with respect to the slide-in direction; and wherein the roller, by running up the roller against the oblique run-up face and by elastic deformation of the claw arm, is displaceable past the claw arm into the indentation of the claw.

13. The roller pull-out guide as claimed in claim 1;

wherein the tilt slide includes at least one guide pin which is per force guided displaceably in a guide track.

14. The roller pull-out guide as claimed in claim 13;

wherein the guide track on its, viewed in the slide-in direction, forward end includes an angled-off section.

15. The roller pull-out guide as claimed in claim 13;

wherein the tilt slide comprises at least two guide pins spaced apart in the pull-out direction.

16. The roller pull-out guide as claimed in claim 15;

wherein a first of the guide pins can be slid into the angled-off section.

17. Roller pull-out guide as claimed in claim 16;

wherein the other guide pin forms a swivel axle about which the tilt slide swivels during the sliding-in of the first guide pin into the angled-off section.

18. The roller pull-out guide as claimed in claim 1;

wherein on the tilt slide an attenuator part is disposed of an attenuator comprising at least two attenuator parts movable relative to one another, or the tilt slide is operationally connected with the attenuator part via a connection body.

19. The roller pull-out guide as claimed in claim 1, claim 1;

wherein the guide rail, viewed in the slide-in direction, is angled off in its end region, wherein the roller is guidable into this end region.

20. The roller pull-out guide as claimed in claim 1;

wherein the tilt slide is displaceably and tiltably supported in a housing and the housing has a U-shaped recess in which the guide rail is supported with its, viewed in the slide-in direction, rearward end.

21. The roller pull-out guide as claimed in claim 20;

wherein the housing is realized such that it is elastically resilient and can be snapped onto the guide rail.

22. The roller pull-out guide as claimed in claim 1;

wherein the tilt slide is displaceably and tiltably supported in a housing and the housing, viewed in an operating position of the roller pull-out guidance, is disposed above or beneath the guide rail.

23. The roller pull-out guide as claimed in claim 1;

wherein the tilt slide is displaceably and tiltably supported in a housing; and wherein the housing, viewed in an operating position of the roller pull-out guidance, is disposed completely above or completely beneath the guide rail.

24. The roller pull-out guide as claimed in claim 2;

wherein a first coupling part is disposed on the tilt slide;

wherein a second coupling part is disposed on the second rail;

wherein the coupling parts, in a first tilt position of the tilt slide, are detached from one another and, in a second tilt position of the tilt slide, are engaged with one another;

wherein, in the first tilt position, the second rail and the tilt slide are movable relative to one another in the pull-out direction, or in the slide-in direction, or in the pull-out direction and the slide-in direction; and wherein, in the second tilt position, the second rail and the tilt slide are per force coupled with one another with respect to a movement in the pull-out direction, or in the slide-in direction, or in the pull-out direction and the slide-in direction.

25. A method of operating a roller pull-out guide as claimed in claim 24;

wherein the tilt slide by the roller occurring onto the claw is tilted from the first tilt position into the second tilt position;

wherein, through this tilting, the coupling parts are brought into engagement with one another; and wherein, subsequent to the engagement of the coupling parts, the second rail, via the coupling parts caught on the tilt slide, is pulled by the tilt slide in the slide-in direction.

* * * * *